US006345740B1

(12) United States Patent
Riebe

(10) Patent No.: US 6,345,740 B1
(45) Date of Patent: Feb. 12, 2002

(54) VALVE FOR AEROSOL CONTAINER

(75) Inventor: Michael Thomas Riebe, Raleigh, NC (US)

(73) Assignee: Glaxo Wellcome Inc., Research Triangle Park, NC (US)

( * ) Notice: Subject to any disclaimer, the term of this patent is extended or adjusted under 35 U.S.C. 154(b) by 0 days.

(21) Appl. No.: 09/446,163

(22) PCT Filed: Jul. 27, 1998

(86) PCT No.: PCT/EP98/04681

§ 371 Date: Dec. 16, 1999

§ 102(e) Date: Dec. 16, 1999

(87) PCT Pub. No.: WO99/06303

PCT Pub. Date: Feb. 11, 1999

(30) Foreign Application Priority Data

Jul. 29, 1997 (GB) ..... 9715855

(51) Int. Cl.[7] ..... B65D 83/00
(52) U.S. Cl. ..... 222/402.1; 277/945
(58) Field of Search ..... 222/402.1, 542; 277/945

(56) References Cited

U.S. PATENT DOCUMENTS

| | | | | |
|---|---|---|---|---|
| 3,595,589 A | * | 7/1971 | Henderson | 277/945 |
| 5,027,986 A | | 7/1991 | Heinzel et al. | |
| 5,427,282 A | * | 6/1995 | Greenleaf et al. | 222/402.1 |
| 5,551,706 A | * | 9/1996 | Batna et al. | 277/545 |

FOREIGN PATENT DOCUMENTS

| | | |
|---|---|---|
| FR | 2144386 A | 2/1973 |
| FR | 2740527 A | 4/1997 |
| WO | 95/02651 | 1/1995 |
| WO | WO96 32344 A | 10/1996 |

OTHER PUBLICATIONS

R.J. Ratway and C.M. Balik, "Surface Modification of Chlorobutyl Rubber by Plasma Polymerization," *J. Polymer Science Part B: Polymer Physics Edition*, 35 1651 (1997).

R.J. Ratway and C.M. Balik, "Surface Modification of Nitrile Rubber by Plasma Polymerization," *Plasmas and Polymers*, 3(2), 129 (1988).

* cited by examiner

*Primary Examiner*—Philippe Derakshani
(74) *Attorney, Agent, or Firm*—Christopher P. Rogers

(57) ABSTRACT

The invention is directed to a valve for an aerosol container for dispersing a suspension or solution of a medicament in a liquid propellant contained therein. The valve comprises a valve body defining an aperture, a seal mounted at the aperture, and a valve stem having a dispensing passage. The valve stem being slideably moveable through the seal such that in a first position the valve is closed to prevent the medicament and propellant from entering the dispensing passage. The valve stem also being such that in a second position the valve is open to allow the substance to be dispensed through the dispensing passage. The valve seal characterized in that it is constructed from a nitrile-containing rubber and micronized fluorine-containing polymer.

23 Claims, 1 Drawing Sheet

VALVE FOR AEROSOL CONTAINER

Figure 1:
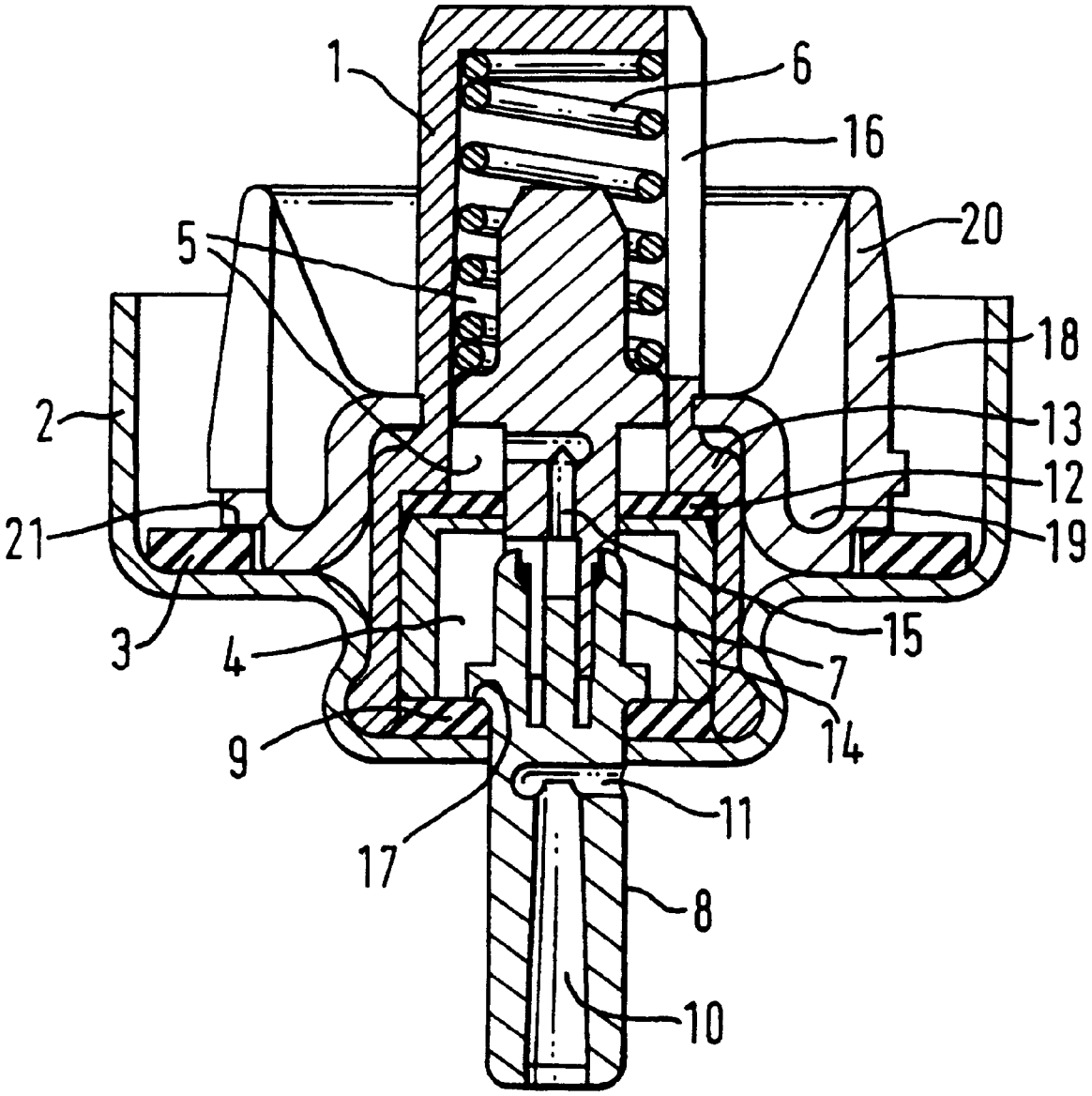

This application is filed pursuant to 35 U.S.C §371 as a United States National Phase Application of International Application No. PCT/EP98/04681 filed Jul. 27, 1998, which claims priority from GB 9715855.4 filed Jul. 29, 1997.

FIELD OF THE INVENTION

This invention relates to a valve for an aerosol container with the aid of which a quantity of the contents thereof can be dispensed. The invention has particular application to the dispensing of metered doses of medicaments, though it is applicable to the dispensing of aerosols generally.

The continuing use of aerosol formulations comprising conventional chlorofluorocarbon propellants is being debated due to the suspected role of such propellants in atmospheric depletion of ozone. Accordingly, formulations based on alternative propellants such as HFA-134a (1,1,1,2-tetrafluoroethane) and HFA-227 (1,1,1,2,3,3,3-heptafluoropropane) are being developed to replace those conventional propellants thought to contribute to atmospheric ozone depletion.

Containers for aerosol formulations commonly comprise a vial body coupled to a valve. The valve comprises a valve stem through which the formulations is dispensed. Generally the valve includes a rubber valve seal intended to allow reciprocal movement of the valve stem while preventing leakage of propellant from the container.

It has been found that some conventional devices for delivering aerosols suffer impaired performance when used in connection with HFA-134a or HFA-227. Selection of suitable materials for use in valves to contain aerosol formulations based on these alternative propellants is complicated by interactions between the valve component materials and the formulation components, including the propellant. In conventional devices, particularly with some drug formulations the valve stem tends to stick, pause, or drag during the actuation cycle with the result that the user perceives an unsmooth action as the valve stem is depressed and released. This may be partly caused by the drug to be dispensed from the container sedimenting or precipitating out of the drug-propellant suspension or solution formulation and depositing on the internal valve components, the presence of drug on the sliding interface between valve stem and seal creating increased friction during operation.

International Patent Application No. PCT/US94/06900 describes an aerosol valve wherein the rubber valve seal is made of a composition specially selected to minimise leakage of the propellant through the interface between the valve seal and valve stem upon firing. Smoothness of operation is also improved with some formulations compared to devices involving conventional thermoset rubber seals. However, although such seal compositions may improve valve performance, they do not prevent build up of deposit on the valve components, and the problem of unsmooth action may persist.

SUMMARY OF THE INVENTION

It is an object to provide a valve with improved smoothness of operation which alleviates the problem of valve sticking.

According to one aspect of the present invention there is provided a valve for an aerosol container for dispensing a suspension of a substance in a liquid propellant contained therein, the valve comprising a valve body defining an aperture, a seal mounted at the aperture, and a valve stem having a dispensing passage, the valve stem being moveable through the seal such that in a first position the valve is closed to prevent the substance to be dispensed from entering the dispensing passage, and in a second position the valve is open to allow the substance to be dispensed through the dispensing passage, characterised in that the seal is made from a material comprising a fluorine-containing polymer.

According to another aspect of the present invention there is provided a valve seal comprising a fluorinated polymer.

According to a further aspect of the present invention there is provided an aerosol container comprising a valve as described herein.

Fluorine-containing polymers suitable for this purpose include polytetrafluoroethane (PTFE), ethylenetetrafluoroethylene (ETFE), perfluoroalkoxyalkane (PFA), fluorinated ethylene propylene (FEP), vinyldienefluoride (PVDF), and chlorinated ethylene tetrafluoroethylene.

PTFE has been found to be particularly advantageous as a lubricant due to its low coefficient of friction. Furthermore, PTFE significantly reduces the problem of drug deposition on the surface of the seal contacting the valve stem, so removing one of the causes of valve sticking. Micronised PTFE can be incorporated in a straight forward manner as part of the filler material for standard peroxide cured nitrile-based rubber seals in a normal mixing process. Alternatively, the surface of the seal component may be subjected to a fluorination process. PTFE is also non-toxic, an important consideration for aerosol devices for dispensing medicaments.

Suitably, the seal is made from a material which comprises up to 20 parts by weight of PTFE in 100 parts by weight of base polymer. Preferably, the seal comprises 5 to 10% by weight of PTFE.

Suitably, the valve is a metering valve comprising a metering chamber, a transfer passage through which a quantity of substance to be dispensed can pass from the container into the metering chamber, wherein in the first position the dispensing passage is isolated from the metering chamber by means of a first seal and the metering chamber is in communication with the container via the transfer passage, and in the second position the dispensing passage is in communication with the metering chamber and the transfer passage is isolated from the metering chamber by means of a second seal. The second seal may advantageously also be made of a material comprising a fluorine-containing polymer like the first seal.

Suitably the substance to be dispensed is a medicament suspended or dissolved in liquefied HFA3/4a or HFA-227.

Medicaments suitable for this purpose are, for example for the treatment of respiratory disorders such as asthma, bronchitis, chronic obstructive pulmonary diseases and chest infections. Additional medicaments may be selected from any other suitable drug useful in inhalation therapy and which may be presented as a suspension. Appropriate medicaments may thus be selected from, for example, analgesics, e.g. codeine, dihydromorphine, ergotamine, fentanyl or morphine; anginal preparations, e.g. diltiazem; antiallergics, e.g. cromoglycate, ketotifen or neodocromil; antiinfectives e.g. cephalosporins, penicillins, streptomycin, sulphonamides, tetracyclines and pentamidine; antihistamines, e.g. methapyrilene anti-inflammatories, e.g. fluticasone propionate, beclomethasone dipropionate, flunisolide, budesonide or triamcinolone acetonide; antitussives, e.g. noscapine; bronchodilators, e.g. salmeterol, salbutamol, ephedrine, adrenaline, fenoterol, formoterol, isoprenaline, metaproterenol, phenylephrine, phenylpropanolamine, pirbuterol, reproterol, rimiterol, terbutaline, isoetharine, tulobuterol orciprenaline, or (–)-4-amino-3,5-dichloro-α-[[[6-[2-(2-pyridinyl)ethoxy]-hexyl]amino]methyl] benzenemethanol; diuretics, e.g. amiloride; anticholinergics e.g. ipratropium, atropine or oxitropium; hormones, e,g, cortisone, hydrocortisone or prednisolone; xanthines e.g. aminophylline, choline theophyllinate, lysine theophyllinate or theophylline and therapeutic proteins and peptides, e.g. insulin or glucagon. It will be clear to a person skilled in the art that, where appropriate, the medicaments may be used in the form of salts (e.g. as alkali metal or amine salts or as acid addition salts) or as esters (e.g. lower alkyl esters) or as solvates (e.g. hydrates) to optimise the activity and/or stability of the medicament. Preferred medicaments are salbutamol, salbutamol sulphate, salmeterol, salmeterol xinafoate, fluticasone propionate, beclomethasone dipropionate and terbutaline sulphate. It is to be understood that the suspension or solution of medicament may consist purely of one or more active ingredients.

Preferably the medicament is salmeterol xinafoate, salbutamol sulphate, fluticasone propionate or a combination thereof.

The invention will now be described further with reference to the accompanying drawing in which FIG. 1 is a section through a metering valve according to the invention.

A valve according to the invention is shown in FIG. 1 and comprises a valve body 1 sealed in a ferrule 2 by means of crimping, the ferrule itself being set on the neck of a container (not shown) with interposition of a gasket 3 in a well-known manner. The container is filled with a suspension of salmeterol xinafoate in liquid propellant HFA134a.

The valve body 1 is formed at its lower part with a metering chamber 4, and its upper part with a sampling chamber 5 which also acts as a housing for a return spring 6. The words "upper" and "lower" are used for the container when it is in a use orientation with the neck of the container and valve at the lower end of the container which corresponds to the orientation of the valve as shown in FIG. 1. Inside the valve body 1 is disposed a valve stem 7, a part 8 of which extends outside the valve through a first lower stem seal 9 and ferrule 2. The stem part 8 is formed with an inner axial or longitudinal canal 10 opening at the outer end of the stem and in communication with a radial passage 11.

The upper portion of stem 7 has a diameter such that it can pass slidably through an opening in a second upper stem seal 12 and will engage the periphery of that opening sufficiently to provide a seal. Both seals 9 and 12 are made from a peroxide cured nitrile rubber comprising 15 parts of PTFE in 100 parts of base polymer, the former component having the effect of reducing the friction between the seals and valve stem during actuation, as explained below. PTFE also has the effect of reducing any build up of drug deposition on the surface of the seal contacting the valve stem, the presence of which on the sliding interface between the valve stem and seal could otherwise cause increased friction during actuation. Upper stem seal 12 is held in position against a step 13 formed in the valve body 1 between the said lower and upper parts by a sleeve 14 which defines the metering chamber 4 between lower stem seal 9 and upper stem seal 12. The valve stem 7 has a passage 15 which, when the stem is in the inoperative position shown, provides a communication between the metering chamber 4 and sampling chamber 5, which itself communicates with the interior of the container via orifice 16 formed in the side of the valve body 1.

Valve stem 7 is biased downwardly to the inoperative position by return spring 6 and is provided with a shoulder 17 which abuts against lower stem seal 9. In the inoperative position as shown in FIG. 1 shoulder 17 abuts against lower stem seal 9 and radial passage 11 opens below lower stem seal 9 so that the metering chamber 4 is isolated from canal 10 and suspension inside cannot escape.

A ring 18 having a "U" shaped cross section extending in a radial direction is disposed around the valve body below orifice 16 so as to form a trough 19 around the valve body. As seen in FIG. 1 the ring is formed as a separate component having an inner annular contacting rim of a diameter suitable to provide a friction fit over the upper part of valve body 1, the ring seating against step 13 below the orifice 16. However, the ring 18 may alternatively be formed as an integrally moulded part of valve body 1.

To use the device the container is first shaken to homogenise the suspension within the container The user then depresses the valve stem 7 against the force of the spring 6. When the valve stem is depressed both ends of the passage 15 come to lie on the side of upper stem seal 12 remote from the metering chamber 4. Thus a dose is metered within the metering chamber. Continued depression of the valve stem will move the radial passage 11 into the metering chamber 4 while the upper stem seal 12 seals against the valve stem body. Thus, the metered dose can exit through the radial passage 11 and the outlet canal 10.

Releasing the valve stem causes it to return to the illustrated position under the force of the spring 6. The passage 15 then once again provides communication between the metering chamber 4 and sampling chamber 5. Accordingly, at this stage liquid passes under pressure from the container through orifice 16, through the passage 15 and thence into the metering chamber 4 to fill it.

It has been found that the valve described above offers consistently smoother actuation throughout its life compared with valves using conventional nitrile-based rubber seals having no PTFE when used to dispense the same product. The following table presents a comparison of the mean friction energy generated in valves during actuation of two aerosol containers having standard nitrile-based rubber seals against two containers having PTFE impregnated seals at different stages during the life of the containers.

| | Friction Energy (mJ) | | |
|---|---|---|---|
| Valve | Start of can | After 100 actuations | After 200 actuations |
| Standard | 40 | 50 | 52 |
| With PTFE impregnated seals | 38 | 40 | 40 |

The containers used to generate this data contained a suspension of salbutamol sulphate in liquefied HFA134a, and the results illustrate the consistently reduced level of friction present in valves according to the invention compared with valves having conventional seals.

It will be understood that the present disclosure is for the purpose of illustration only and the invention extends to modifications, variations and improvements thereto.

What is claimed is:

1. A valve comprising:

a valve body defining an aperture, a valve stem having a dispensing passage, the valve stem adapted to slidingly engage a seal, and, the seal constructed from one or more rubbers impregnated with one or more fluorine-containing polymers, wherein the valve is suitable for dispensing a drug formulation comprising one or more medicaments and one or more liquid propellants, and, wherein the medicament is a member selected from the group consisting of salbutamol, beclomethasone dipropionate, terbutaline, salmeterol, fluticasone, formoterol, ipratroprium, budesonide; salts, esters, and solvates thereof; and, combinations thereof.

2. The valve of claim 1, wherein the seal comprises up to 20% by weight polytetrafluoroethane.

3. The valve of claim 1, wherein the fluorine-containing polymer is selected from the group consisting of polytetrafluoroethane, ethylenetetrafluoroethylene, perfluoroalkoxyalkane, fluorinated ethylene propylene, vinyldienefluoride, chlorinated ethylene tetrafluoroethylene and combinations thereof.

4. The valve of claim 3 wherein the fluorine-containing polymer is polytetrafluoroethane.

5. The valve of claim 1, wherein the medicament is fluticasone propionate and the propellant is 1,1,1,2-tetrafluoroethane, and wherein the medicament is suspended in the liquid propellant.

6. The valve of claim 1, wherein the medicament is salmeterol xinafoate and the propellant is 1,1,1,2-tetrafluoroethane, and wherein the medicament is suspended in the liquid propellant.

7. The valve of claim 1, wherein the medicament is salbutamol sulphate and the propellant is 1,1,1,2-tetrafluoroethane, and wherein the medicament is suspended in the liquid propellant.

8. The valve of claim 1, wherein the medicament is a combination of fluticasone propionate and salmeterol xinafoate, and wherein the medicament is suspended in the liquid propellant.

9. The value of claim 1, wherein seal comprises 5–10 wt. % of the one or more fluorine-containing polymers.

10. The valve of claim 9, wherein the one or more rubbers comprises a nitrile-containing rubber.

11. The valve of claim 10, wherein the nitrile-containing rubber is peroxide cured.

12. An aerosol metering device comprising:

a valve body defining an aperture, a valve stem having a dispensing passage, the valve stem adapted to slidingly engage a seal constructed from one or more rubbers impregnated with one or more fluorine-containing polymers, a metering chamber, and a container, wherein the device is suitable for dispensing a drug formulation comprising one or more medicaments and one or more liquid propellants, and, wherein the medicament is a member selected from the group consisting of salbutamol, beclomethasone dipropionate, terbutaline, salmeterol, fluticasone, formoterol, ipratroprium, budesonide; salts, esters, and solvates thereof; and, combinations thereof.

13. The aerosol metering device of claim 12, wherein the device is adapted to deliver the medicament suspended in the aerosol which is selected from the group consisting of 1,1,1,2-tetrafluoroethane, 1,1,1,2,3,3,3-heptafluoropropane, and combinations thereof.

14. The aerosol metering device of claim 13, wherein the medicament is a member selected from the group consisting of salbutamol sulphate, salmeterol xinafoate, fluticasone propionate and combinations thereof.

15. The aerosol metering device of claim 12, wherein the medicament is selected from the group consisting of a respiratory disorder medicament, an analgesic, an anginal preparation, an antiallergic, an antiinfective, an antihistamine, an anti-inflammatory, an antitussive, a bronchodilator, a diuretic, an anticholinergic, a hormone, a xanthine, a therapeutic protein, a therapeutic peptide, and combinations thereof.

16. A valve seal comprising:

one or more nitrile-containing rubbers impregnated with one or more fluorine-containing polymers.

17. The valve seal of claim 15, wherein seal comprises 5–10 wt. % of one or more fluorine-containing polymers.

18. The valve seal of claim 16, wherein the fluorine-containing polymer is selected from the group consisting of polytetrafluoroethane, ethylenetetrafluoroethylene, perfluoroalkoxyalkane, fluorinated ethylene propylene, vinyldienefluoride, chlorinated ethylene tetrafluoroethylene and combinations thereof.

19. The valve seal of claim 16, wherein the nitrile-containing rubber is peroxide cured.

20. A valve seal made, in any suitable order, by the steps of:

providing one or more nitrile-containing rubbers, combining the rubber with one or more micronized fluorine-containing polymers to produce a mixture, curing the mixture producing a cured mixture, and manufacturing the seal from the cured mixture.

21. The valve seal of claim 10, wherein the seal comprises 5–10 wt. % of one or more fluorine-containing polymers.

22. The valve seal of claim 10, wherein the fluorine-containing polymer is selected from the group consisting of polytetrafluoroethane, ethylenetetrafluoroethylene, perfluoroalkoxyalkane, fluorinated ethylene propylene, vinyldienefluoride, chlorinated ethylene tetrafluoroethylene and combinations thereof.

23. The valve seal of claim 10, wherein the nitrile-containing rubber is peroxide cured.

* * * * *